US005343979A

United States Patent [19]

Goto

[11] Patent Number: 5,343,979

[45] Date of Patent: Sep. 6, 1994

[54] WORKING GONDOLA

[75] Inventor: Hideo Goto, Kuwana, Japan

[73] Assignee: Doei Gaiso Yugen-Gaisha, Kuwana, Japan

[21] Appl. No.: 797,873

[22] Filed: Nov. 26, 1991

[30] Foreign Application Priority Data

Dec. 17, 1990 [JP] Japan ..... 2-411153
Oct. 14, 1991 [JP] Japan ..... 3-293579

[51] Int. Cl.[5] ..... E04G 3/10

[52] U.S. Cl. ..... 182/147; 182/142; 182/143; 182/37

[58] Field of Search ..... 182/142, 148, 145, 147, 182/143, 144, 37

[56] References Cited

U.S. PATENT DOCUMENTS 705,891 7/1902 Abrams ..... 182/147
4,274,507 6/1981 Williams ..... 182/142 X
4,919,228 4/1990 Stefan ..... 182/142 X

FOREIGN PATENT DOCUMENTS 979600 12/1982 U.S.S.R. ..... 182/37
9366 of 1901 United Kingdom ..... 182/142
9334 of 1903 United Kingdom ..... 182/143

*Primary Examiner*—Blair M. Johnson
*Attorney, Agent, or Firm*—Jordan and Hamburg

[57] ABSTRACT

A working gondola which carries a worker for cleaning e.g. glass windows of a building structure, has two powered winches for winding and unwinding two ropes respectively for up-, down-, left-, and rightward movement of its gondola, whereby cleaning of an extended area can be conducted with efficiency.

3 Claims, 21 Drawing Sheets

WORKING GONDOLA

BACKGROUND OF THE INVENTION

The present invention relates to a working gondola for use in cleaning e.g. glass windows of a building structure.

A known working gondola for use in cleaning the glass windows of a building structure comprises, as shown in FIGS. 23 to 24, a set of outwardly extending gondola support arms C mounted to a body B located on the rooftop of a structure A such as a building, a gondola D suspended by ropes F from the distal ends of the gondola support arms for carrying a worker who conducts a cleaning job, and a powered winch(es) E mounted on the gondola D for winding and unwinding the ropes F to lift the gondola D up and down.

Such a working gondola allows its gondola to be only lifted up and down by winding and unwinding the ropes on the winch(es), thus limiting the widthwise distance of a working range for cleaning a window(s) in each up- and downward movement. As the result, its cleaning action will be less efficient.

Also, the body B on the rooftop of a building structure has to carry a plurality of holders arranged throughout the overall distance of a widthwise working range for sustaining the gondola support arms. It is quite troublesome to move the gondola support arms from one location to another for every vertical cleaning operation.

SUMMARY OF THE INVENTION

For the purpose of overcoming the foregoing disadvantages, it is an object of the present invention to provide an improved working gondola capable of moving its gondola carrying a worker for a cleaning job in up-, down-, left-, and rightward directions through controlling the length of two ropes with a couple of powered winches so that cleaning can be conducted with much ease and at higher efficiency.

Other objects and novel features of the present invention will be apparent from reading of the detailed description in conjunction with the drawings.

The accompanied drawings are provided for ease of understanding and are not meant to limit the scope of the present invention.

DESCRIPTION OF THE PREFERRED EMBODIMENTS

Preferred embodiments of the present invention will be described in detail referring to the accompanying drawings.

Figure 1:
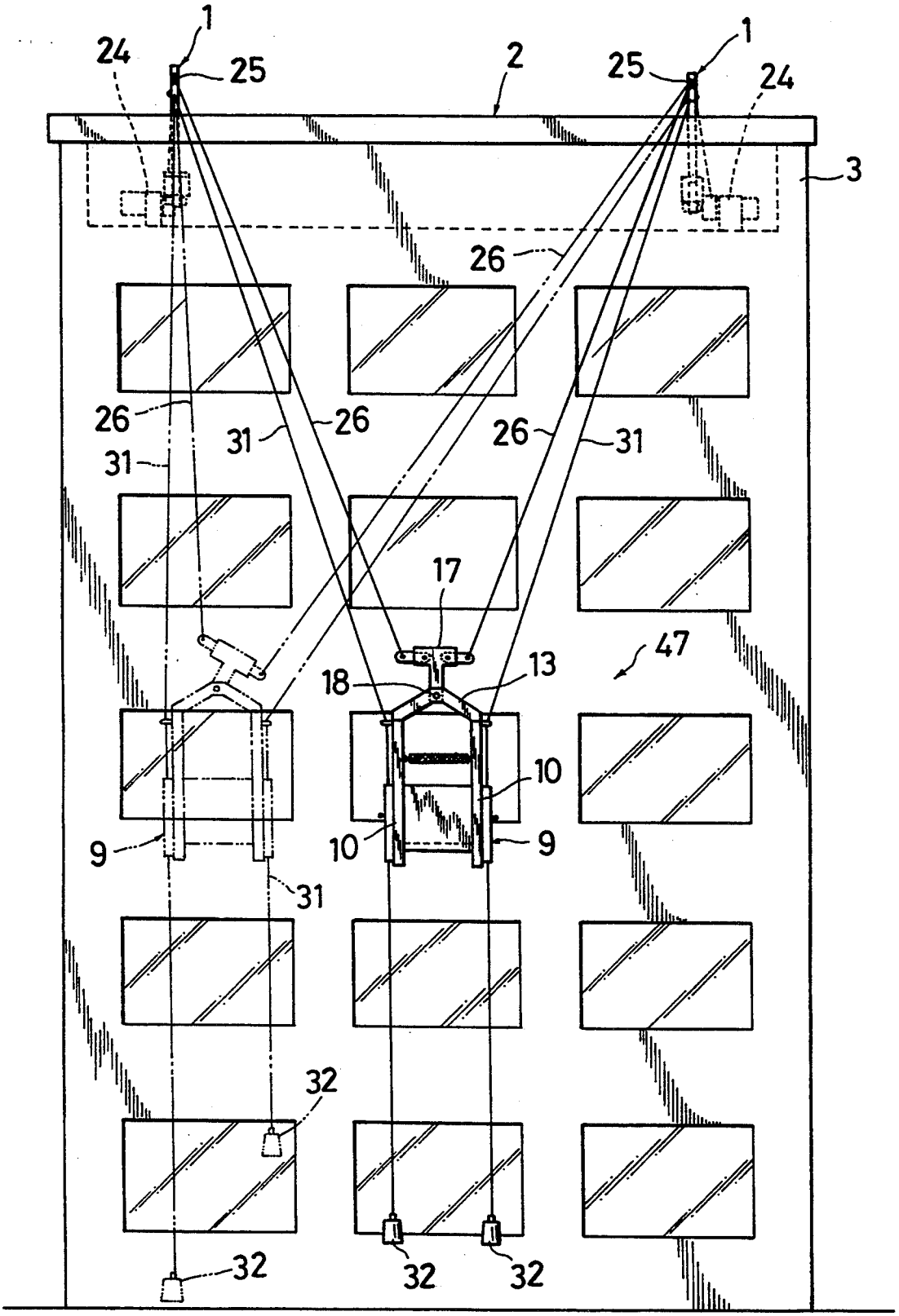
FIG. 1 is a front view showing a first embodiment of the present invention.
Figure 2:
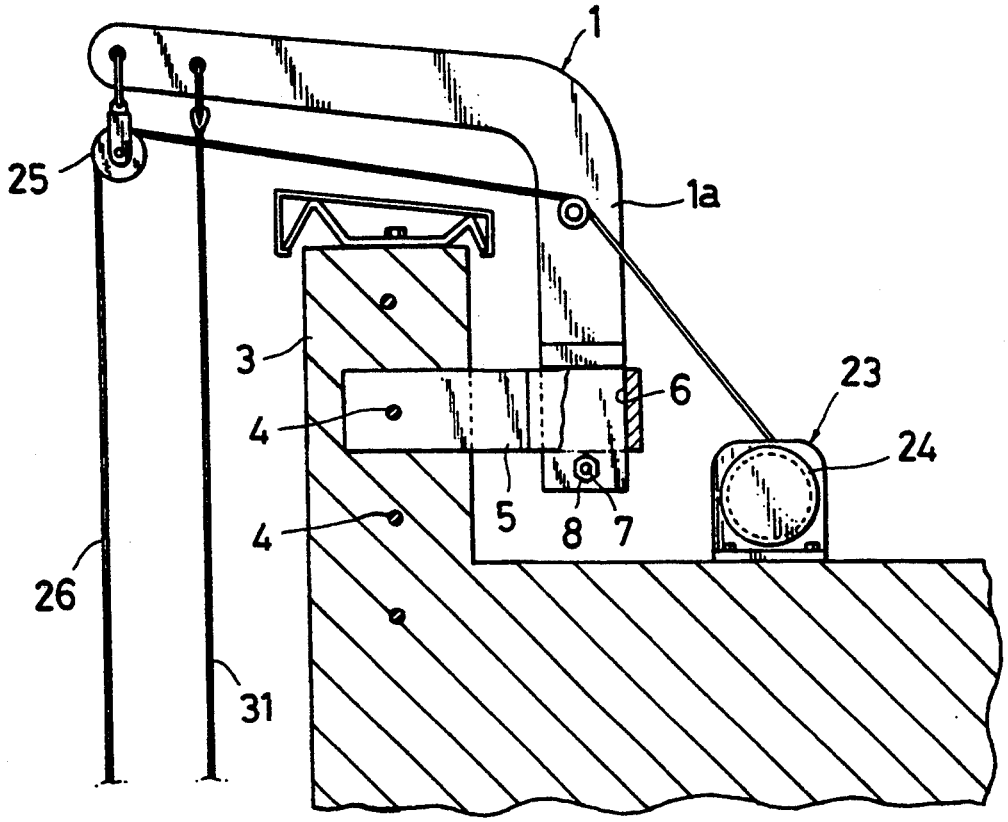
FIGS. 2 and 3 are explanatory views of a gondola support arm.
Figure 3:
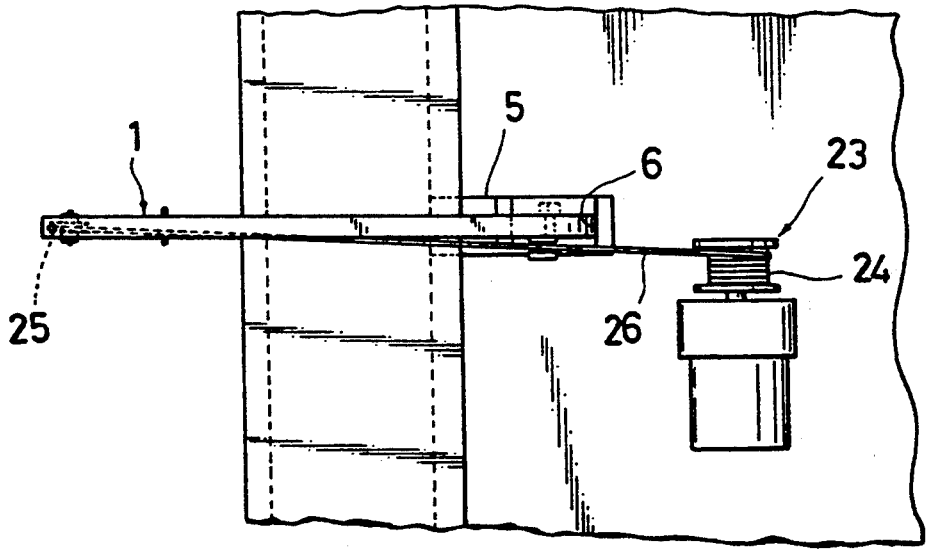

FIGS. 1 to 8 illustrate a first embodiment of the present invention in which are a pair of gondola support arms 1,1 having an inverted L shape extending at its distal end towards the outside and mounted respectively to both ends of the rooftop of a structure 2, e.g. a building, or two regions of a body 3 which are spaced 5 to 10 meters from each other. Each of the gondola support arms 1,1 has its proximal end a support portion **1*a* thereof which is inserted with its lower end protruding downward into the insertion opening of a holder 6 on a fixture 5 fixedly mounted to a steel bar 4 of the body 3 and detachably coupled to the same with a bolt 7 and a nut 8 mounted on the protruded region, as shown in FIGS. 2 and 3**.

Figure 4:
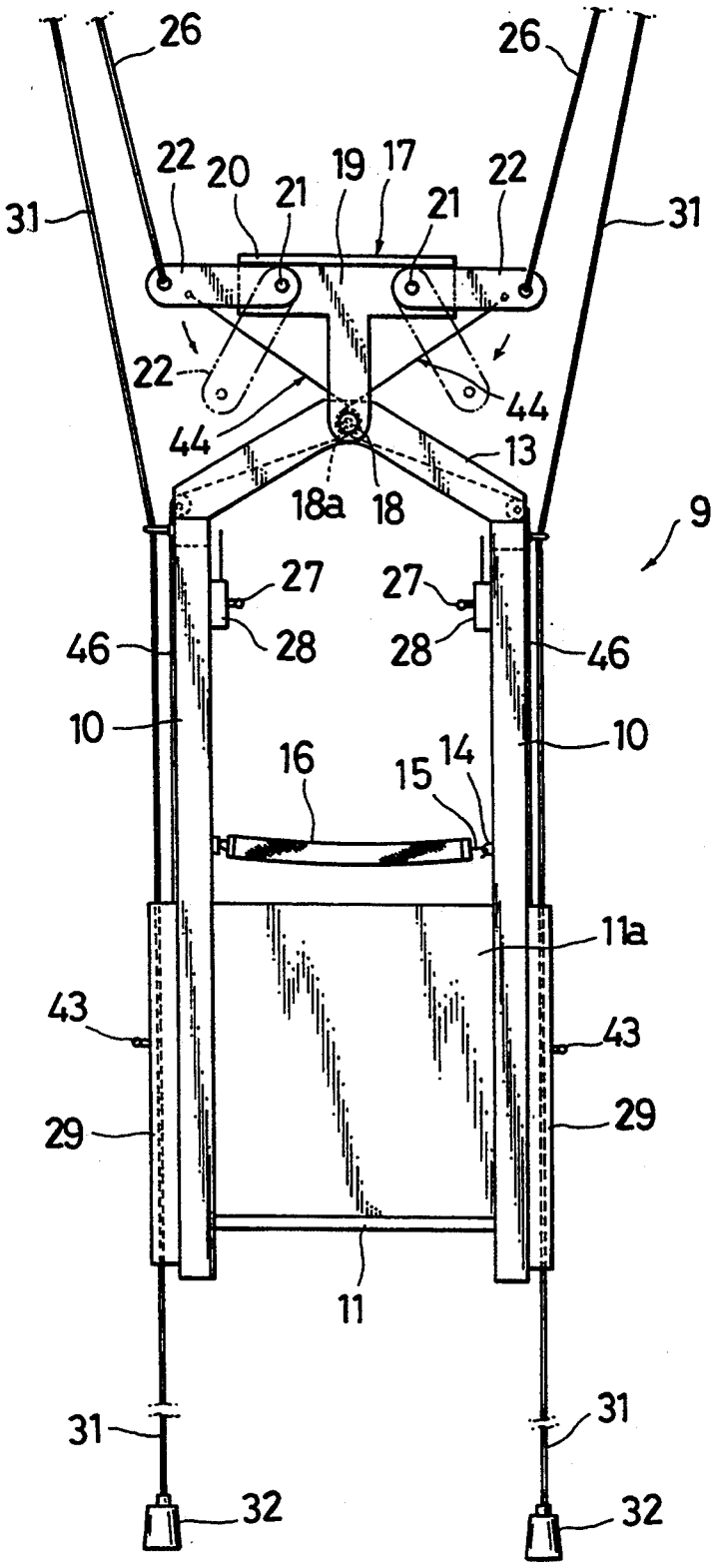
FIGS. 4 to 6 are explanatory views of a gondola.
Figure 5:
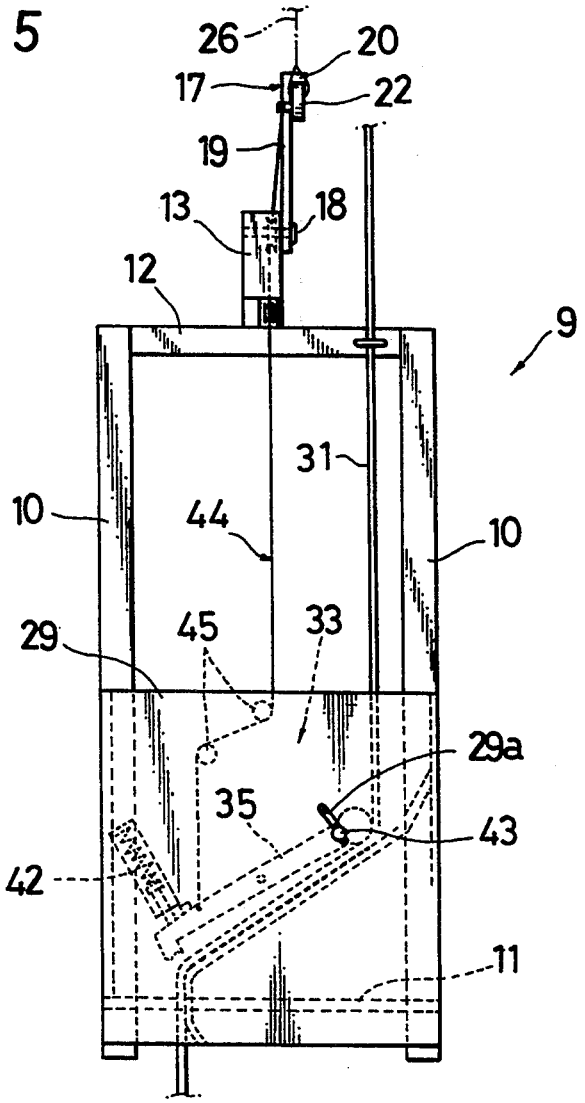
Figure 6:
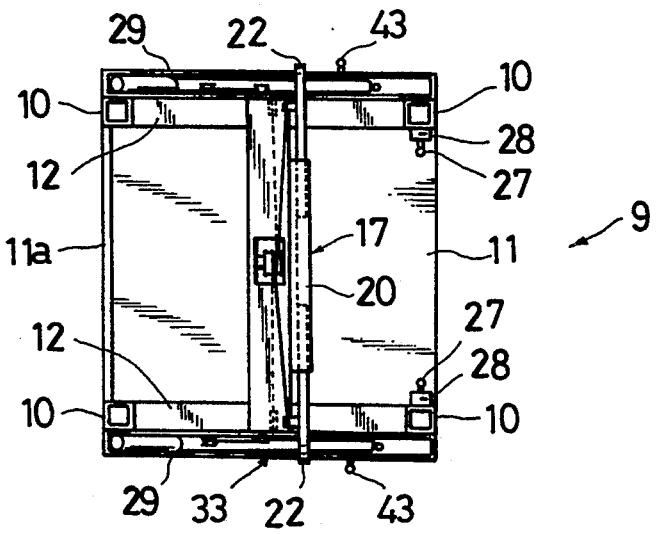

As illustrated in FIGS. 4 to 6, a one-man gondola denoted by the numeral 9 comprises four columns 10,10,10,10 made of pipe materials. A seat plate 11 is provided integral with a back rest **11*a* for sitting on and mounted to the lower ends of the four columns 10,10,10,10 thus coupling all the four columns 10,10,10,10. Two upper tie bars 12,12 extend from front to rear between the upper ends of the four columns 10,10,10,10. An arcuate support arm 13 is mounted at both ends to the center regions of the two tie bars 12,12. A safety belt is mounted at one end to one of the two front columns 10,10 and provided at the other end with a hook 15 which can be engaged with and disengaged from an engaging receptor 14 mounted to the other front column 10**.

Also, there is provided a T-shaped suspender 17 which is pivotably mounted by a pivot pin 18 to the center region of the support arm 13 of the gondola 9. The suspender 17 comprises a T-shaped suspender body 19 having a pivot pin insertion slot **18*a* arranged in the lower end thereof, a stopper 20 provided by folding an upper portion of the suspender body 19 to almost 90 degrees, and two sling arms 22,22 pivotably mounted by pivot pins 21,21 to the two, left and right, ends of the suspender body 19 respectively and also, which can be held up by the stopper 20** in action.

A gondola driver system 23 is also provided on the top of the structure for up-, down-, left-, and rightward movement of the gondola 9, as shown in FIGS. 1 to 3. The gondola driver system 23 comprises a pair of powered winches 24,24 installed at proper locations of the rooftop adjacent to the two gondola support arms 1,1 for being activated by a radio or remote control. Two ropes 26, 26 are wound on their respective winches 24, 24 and extend through two guide members 25, 25 respectively mounted to the front ends of the two gondola arms 1,1 to couple at the front end with the distal ends of the two rope sling arms 22, 22 of the suspender 17 respectively. Two operating panels 28, 28 are mounted to the gondola 9 and carry control levers 27,27 respectively for radio or remote control of their respective powered winches 24, 24.

Figure 7:
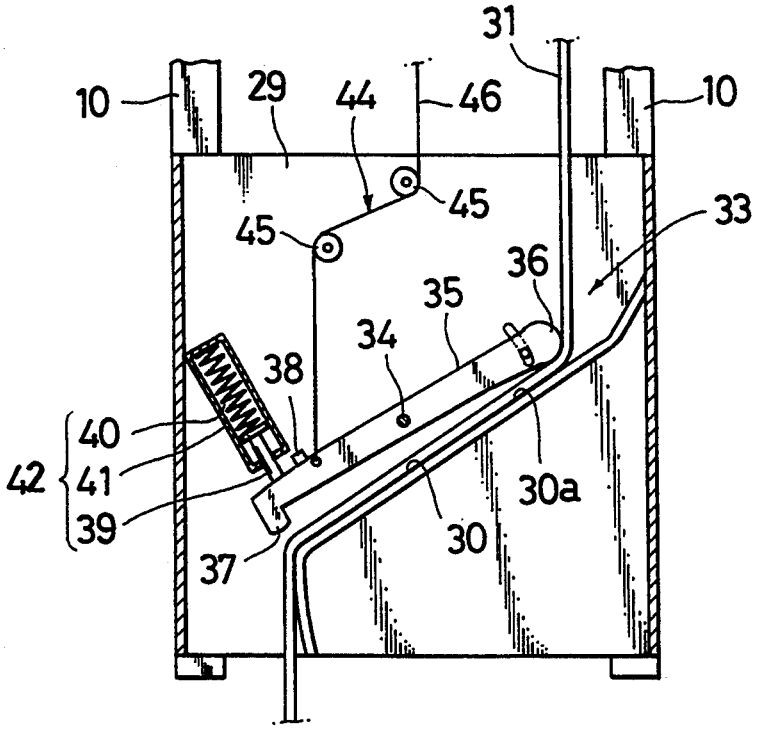
FIGS. 7 and 8 are explanatory views of a lock device.
Figure 8:
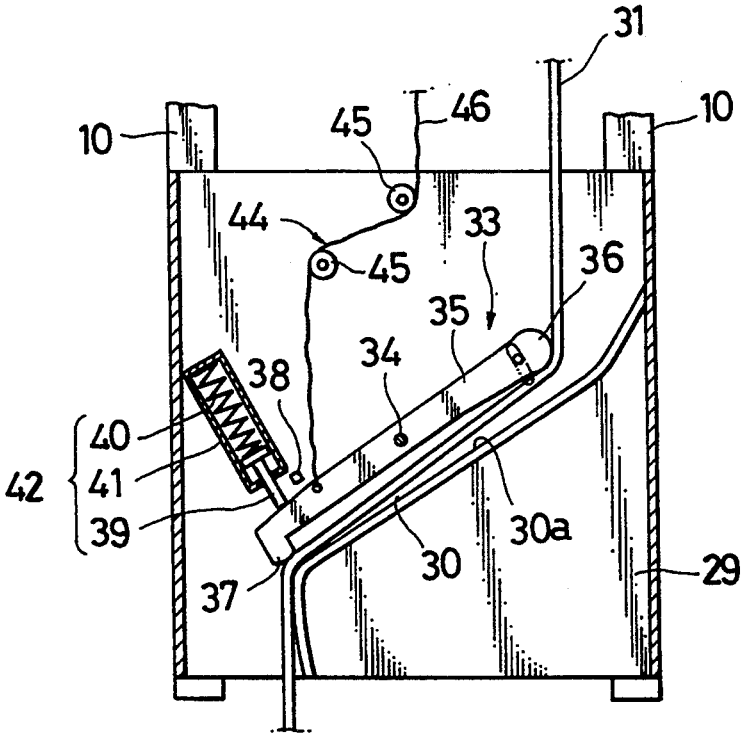

Denoted by the numeral 29 in FIGS. 7 or 8 are a pair of supplementary rope guide cases 29, 29 of tubular shape fixedly mounted to both sides of the gondola 9 for serving as side walls. Each of the two supplementary rope guide cases 29,29 has at its lower region a supplementary rope guide passage 30 of which slope portion 30*a* is tilted thus forming a crank shape.

A pair of supplementary ropes 31,31 are coupled at one end to the distal ends of their respective gondola support arms 1,1 and extend downward through the two supplementary rope guide passages 30,30 of the guide cases 29,29 respectively toward the ground. Each of the two supplementary ropes 31,31 has at the lowermost end a weight 32 for keeping the ropes taut.

In addition, a couple of lock devices 33,33 are provided in the two supplementary rope guide cases 29,29 respectively for locking up the undamaged rope if one of the two supplementary ropes 26,26 of the gondola driver system 23 accidentally snaps. As shown in FIGS. 7 or 8, the lock device 33 comprises a lock lever 35 mounted at its center by a pivot pin 34 to the supplementary rope guide case 29 for pivotal movement above the slope portion 30*a* of the supplementary rope guide passage 30. A supplementary rope guide member 36 is arranged in the upper end of the lock lever 35. A lock tab 37 is arranged in the lower end of the lock lever 35 for pressing down the supplementary rope 31 against the supplementary rope guide passage 30 for lockup. A stopper 38 fixedly mounted to the supplementary rope guide case 29 for holding the lock lever 35 at a given position. A plunger 39 is provided for urging the lock lever 35 in the lockup direction. An urging mechanism 42 consists mainly of a spring 40 and an enclosure 41. Finally, a control bar 43 is mounted to an upper region of the lock lever 35 and extends outward across a long slot 29*a* arranged in the supplementary rope guide case 29.

Two lock release retainers 44,44 are also provided for urging their respective lock levers 33,33 in a lock release direction thus keeping the supplementary ropes 31,31 free to move so that they can cancel the lock release action when its corresponding rope 26 snaps. More specifically, the lock release retainer 44 is a sustaining wire 46 coupled at one end to a lower region of the lock lever 35 and at the other end to distal end of each rope sling arm 22 of the suspender 17 and extending along a couple of guide rolls 45,45 and the pivot pin 18. In a normal state, the sustaining wire 46 is maintained pulled upward thus permitting the lock lever 35 to remain in direct contact with the stopper 38.

In action, a working gondola 47 having the foregoing arrangement can be controlled with the two control levers 27,27 of the control panels 28,28 for activating their respective powered winches 24,24 and thus, rolling in and out the ropes 26, 26 respectively so that the gondola 9 can move upward and downward and also, to the left or right between the two gondola support arms 1,1.

During operation of the working gondola 47, the two lock levers 35,35 of their respective lock devices 33,33 are maintained in contact with the stoppers 38,38 by the lock release retainer 44,44 respectively, as shown in FIG. 7. Hence, both the supplementary ropes 31,31 can move through their respective guide passages 30,30 as the gondola 9 travels up-, down-, left-, and rightward.

If any of the ropes 26,26 which is sustaining the gondola 9 during movement snaps accidentally, the rope sling arm 22 coupled to the snapped rope 26 is turned down by its own weight and the urging force of the spring 40 of the lock device 33, as represented by the imaginary line of FIG. 4. As a result, the sustaining wire 46 of the lock release retainer 44 becomes loose, as shown in FIG. 8, and the lock lever 35 urged by the spring 40 turns downward about the pivot pin 34 thus pressing with its lock tab 37 the supplementary rope 31 against the supplementary rope guide passage 30 for lockup.

Also, the resultant upward movement of the supplementary rope 31 along the supplementary rope guide passage 30 triggers the turning action of the lock lever 35 in the lockup direction thus locking up the supplementary rope 31 systematically.

After the supplementary rope 31 is locked with the lock device 33, the operator can be safely carried to the ground by manually controlling the control bar 43 for lock releasing action of the lock lever 35 and loosening the supplementary rope 31 for letting down the gondola 9.

The other embodiments of the present invention will now be described referring to FIGS. 9 to 22. Like components are represented by like numbers as denoted in the first embodiment and thus, explanation will not be repeated for ease of description.

Figure 9:
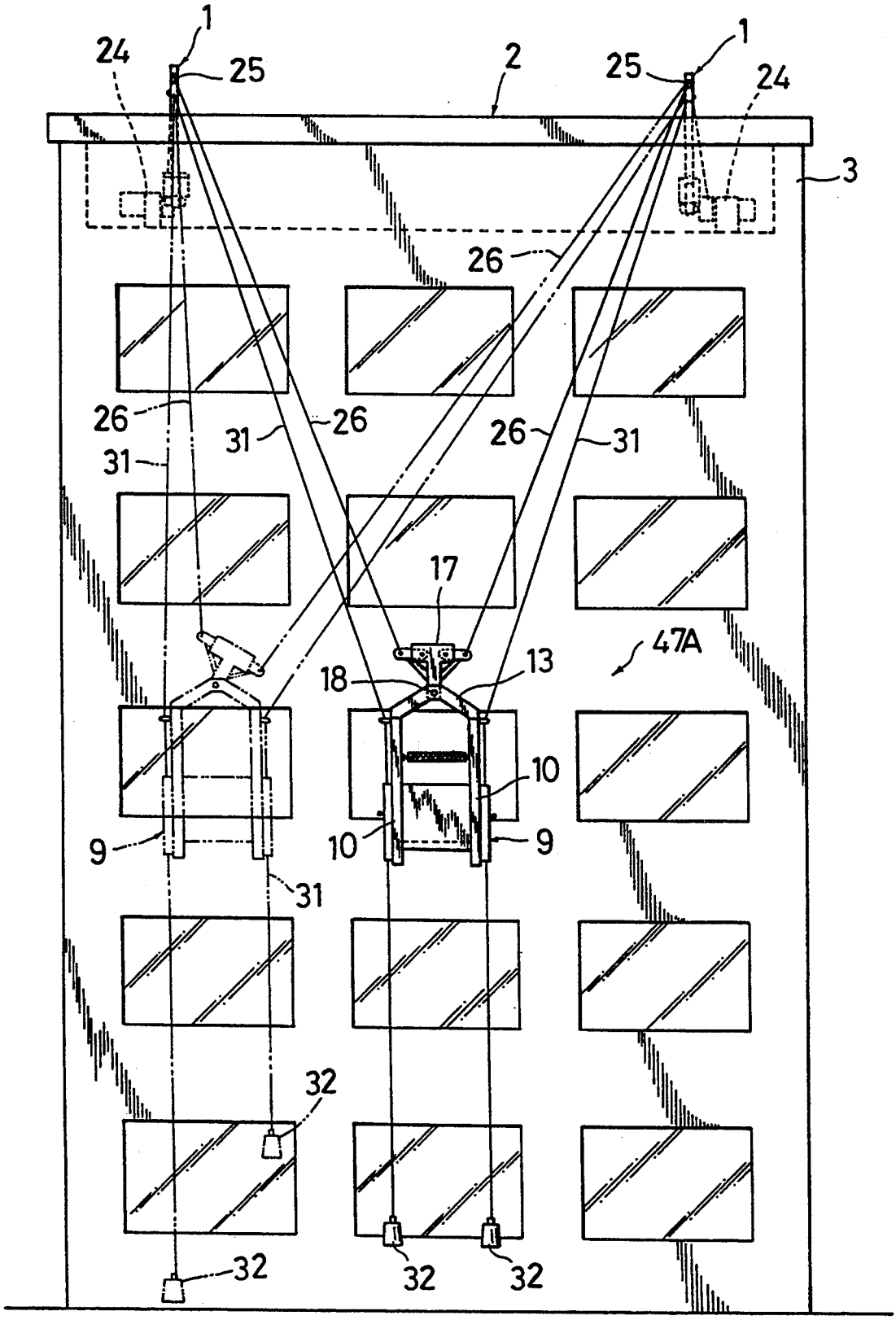
FIGS. 9 to 11 are explanatory views showing a second embodiment of the present invention.
Figure 10:
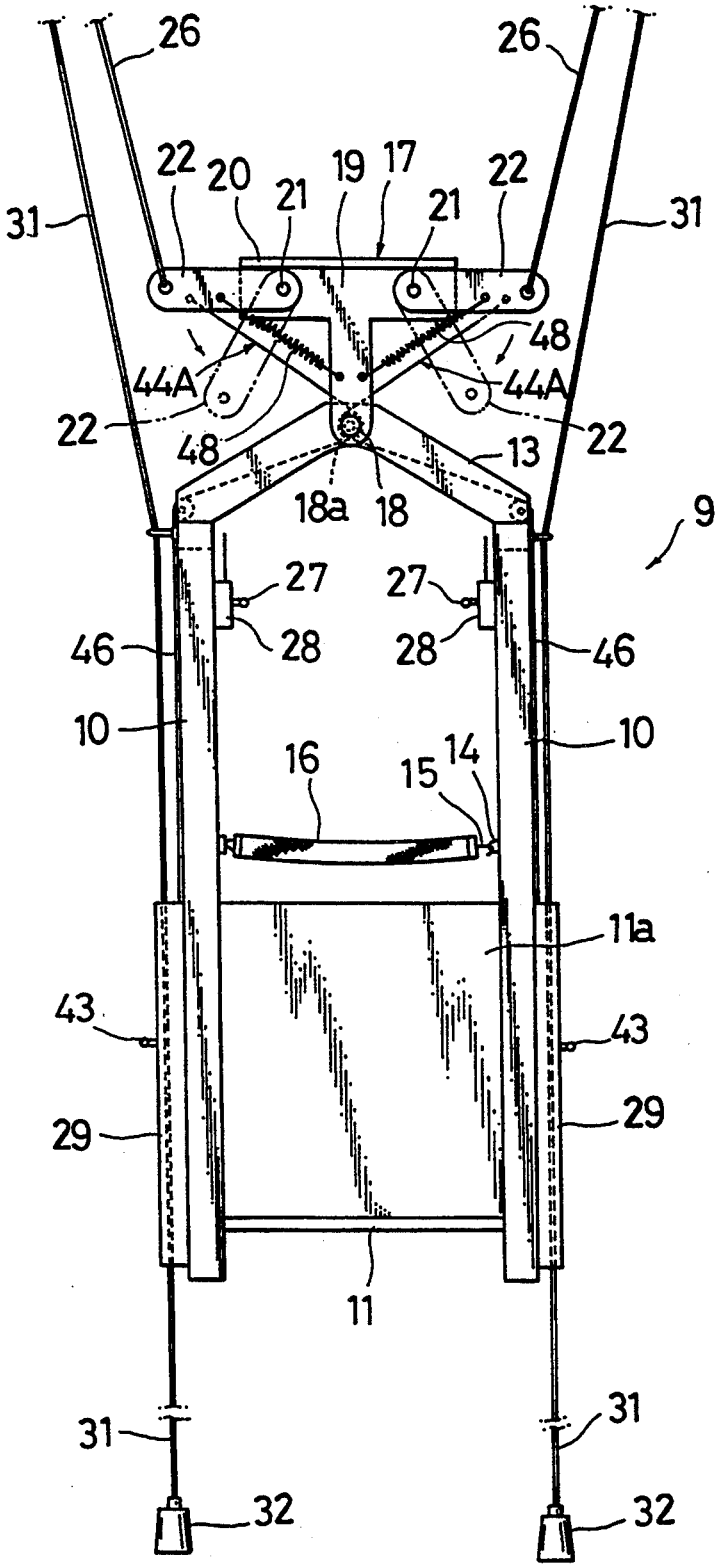
Figure 11:
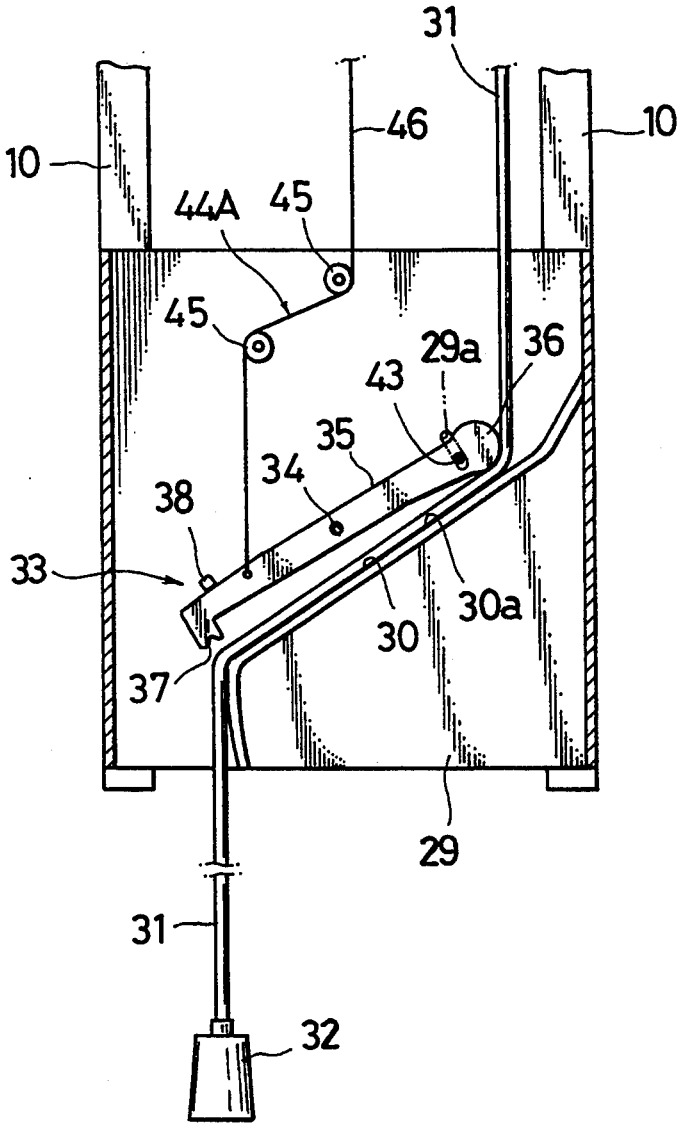

A second embodiment of the present invention shown in FIGS. 9 to 11 is distinguished from the first embodiment by the fact that the two rope sling arms 22,22 of the suspender 17 are provided with two springs 48,48 respectively so that any rope sling arm 22 coupled to the rope 26 which has been snapped can forcedly be pulled downward by the yielding force of the spring 48, which constitute two lock release retainers 44A,44A respectively. A working gondola 47A having such lock release retainers 44A,44A can respond to an inadvertent event with equal success.

The second embodiment may thus employ lock devices furnished with no urging mechanisms.

Figure 12:
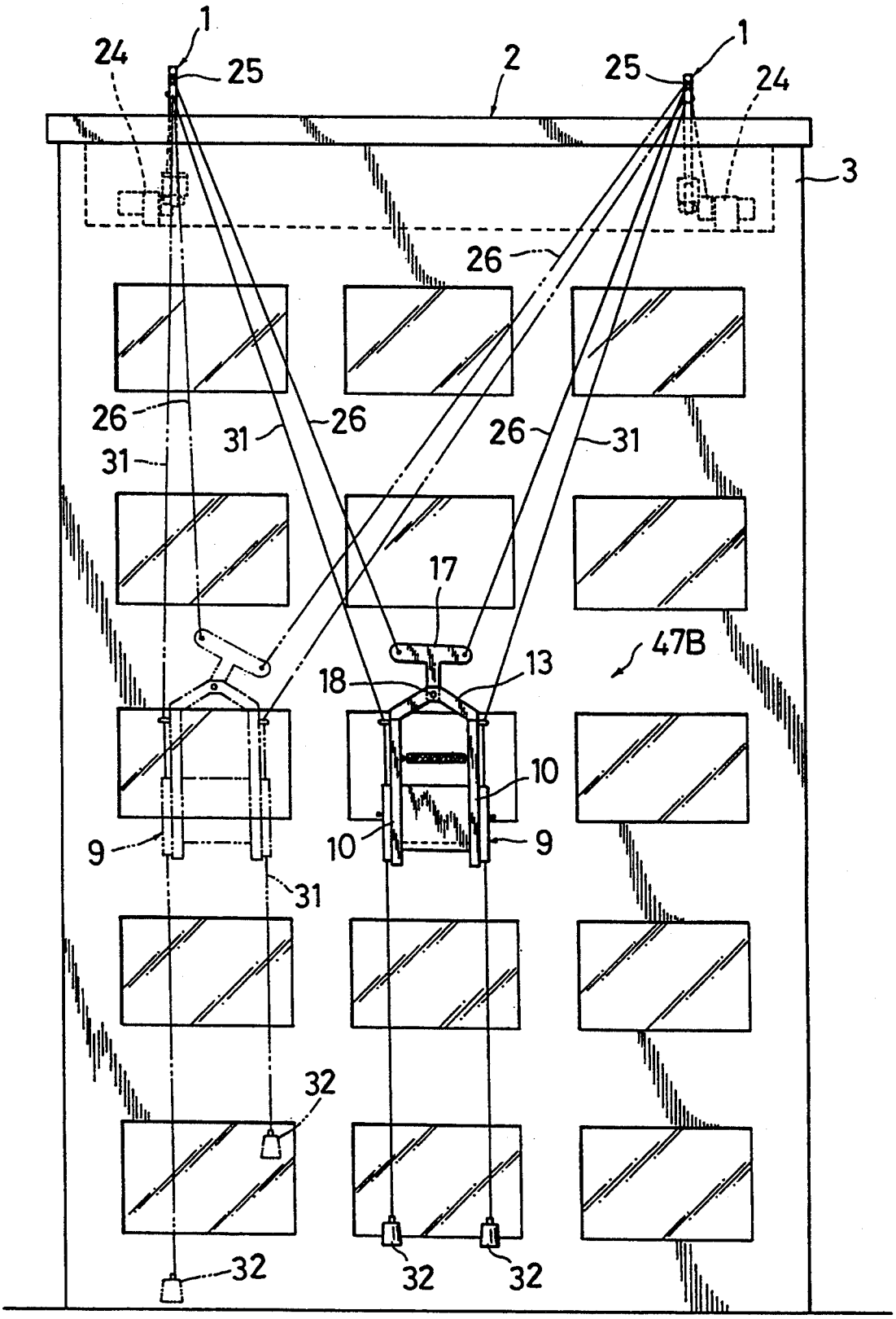
FIGS. 12 to 14 are explanatory views showing a third embodiment of the present invention.
Figure 13:
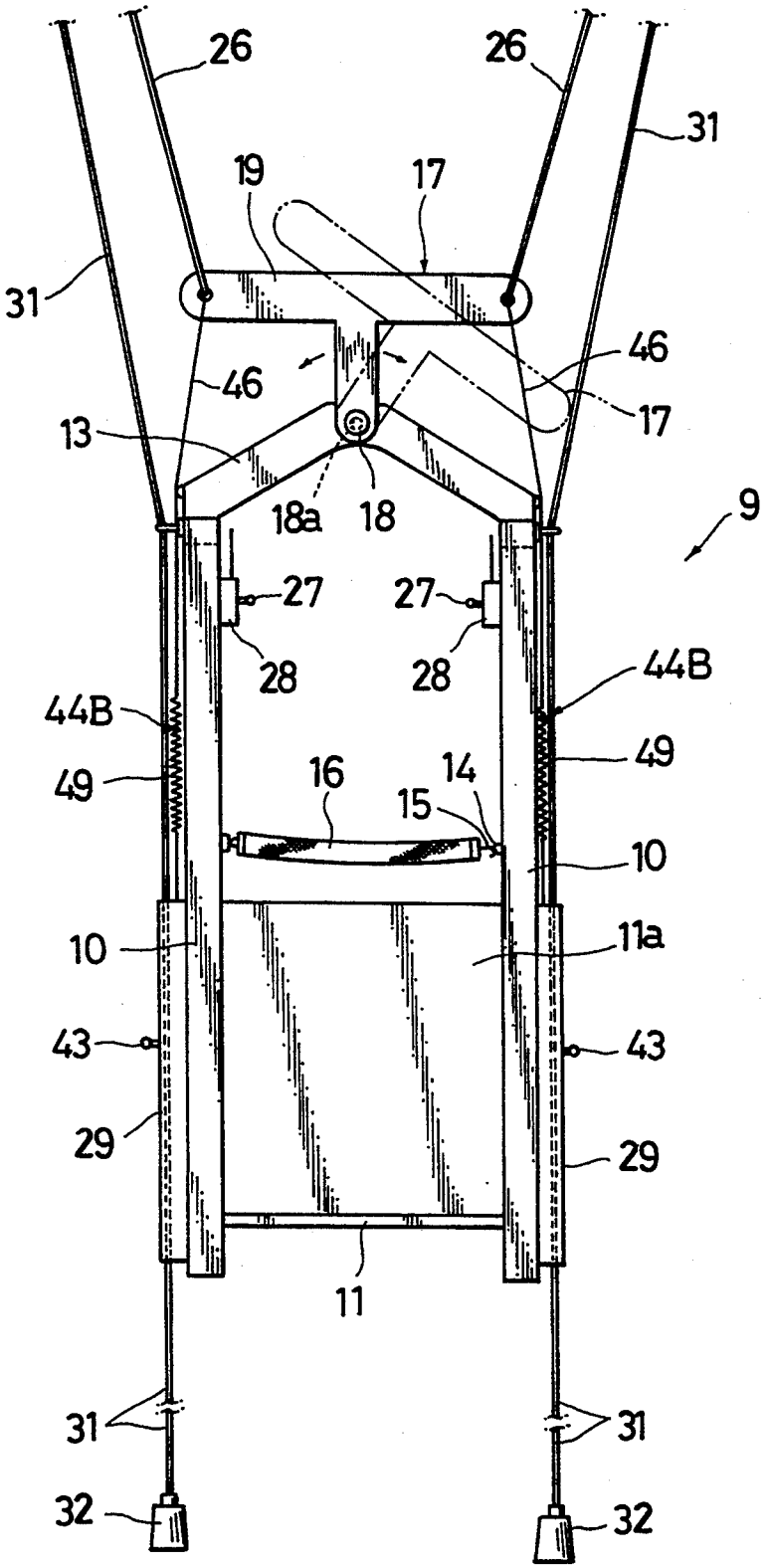
Figure 14:
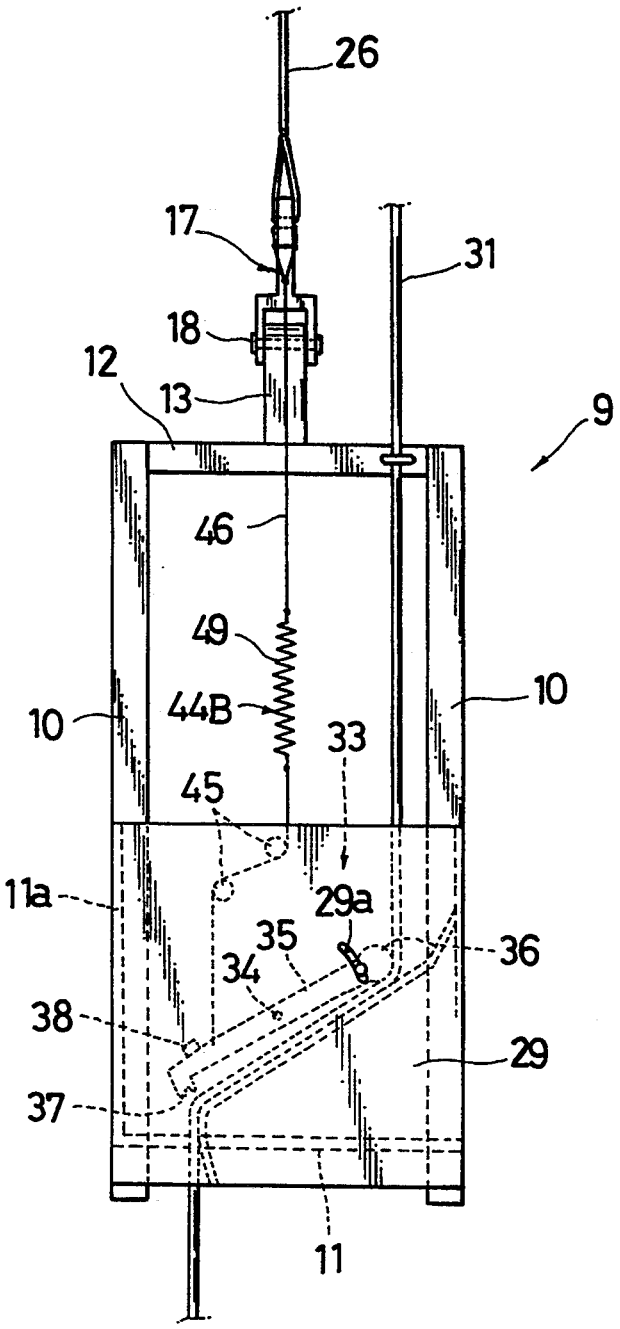

A third embodiment of the present invention shown in FIGS. 12 to 14 is distinguished from the first embodiment by the fact that the suspender 17 is directly coupled with the two sustaining wires 46,46 connected to their respective lock levers 35,35 without extending from the two rope sling arms 22,22 through the pivot pin 18. Also, each of the two sustaining wires 46,46 has a spring 49 arranged intermediate thereof thus forming a lock release retainer 44B. A working gondola 47B having such two lock release retainers 44B,44B can respond to an inadvertent event as well as that of the first embodiment.

Figure 15:
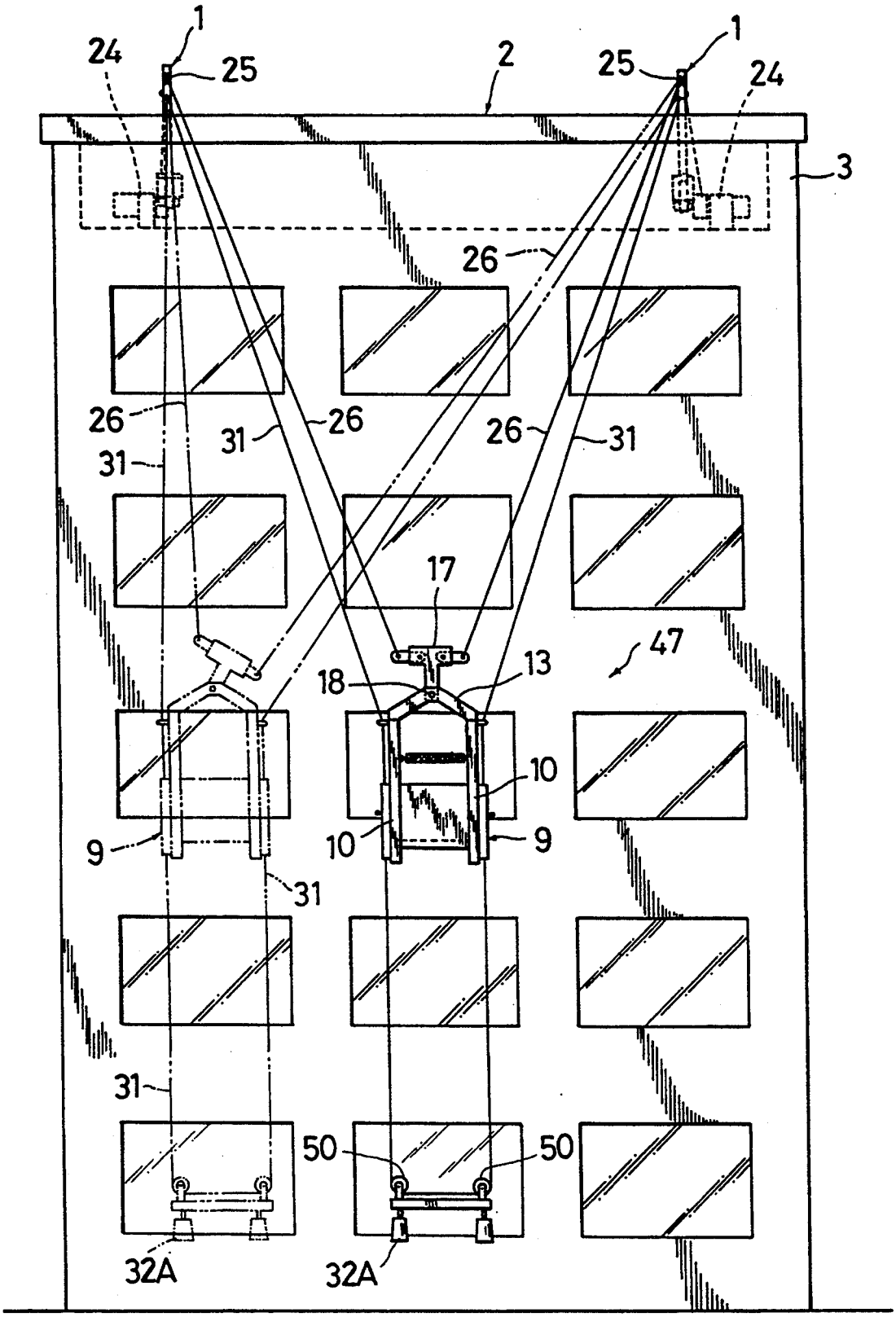
FIGS. 15 to 17 are explanatory views showing a fourth embodiment of the present invention.
Figure 16:
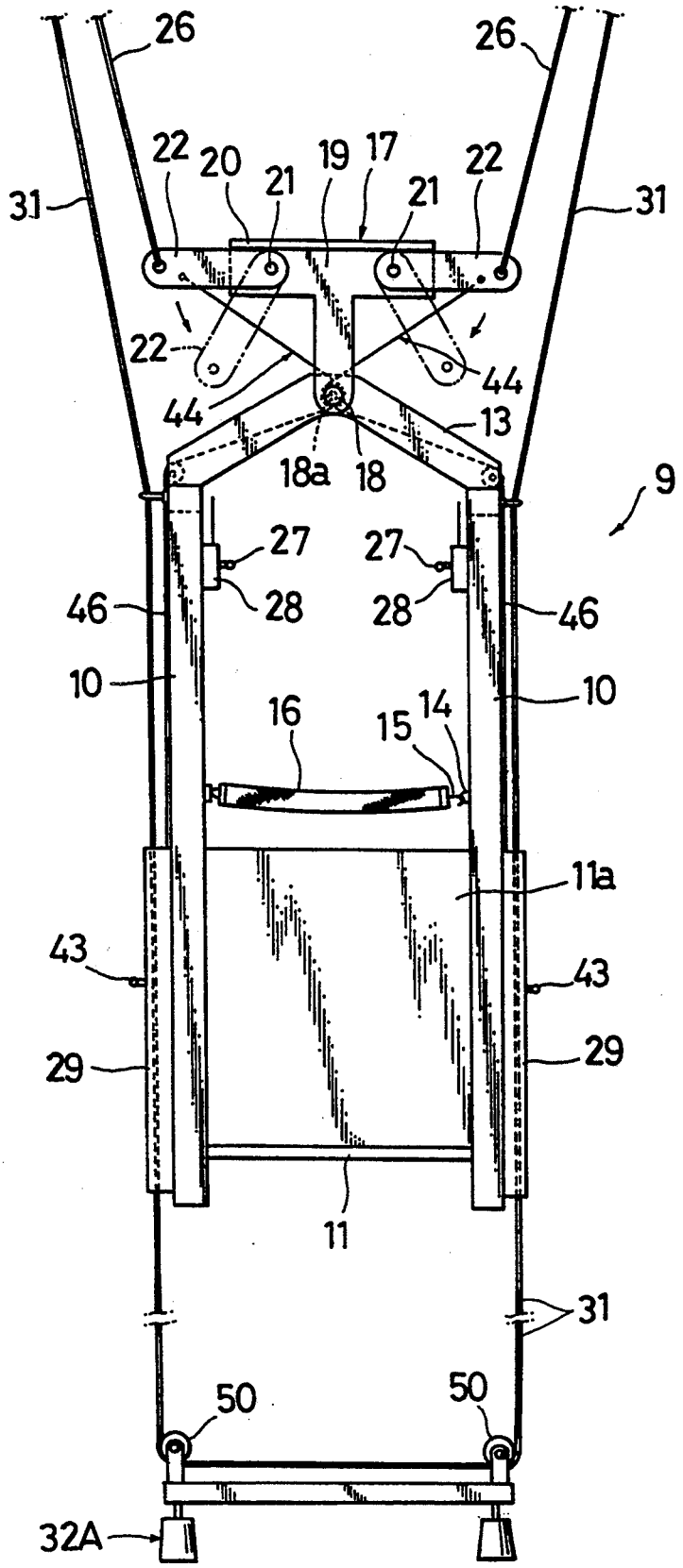
Figure 17:
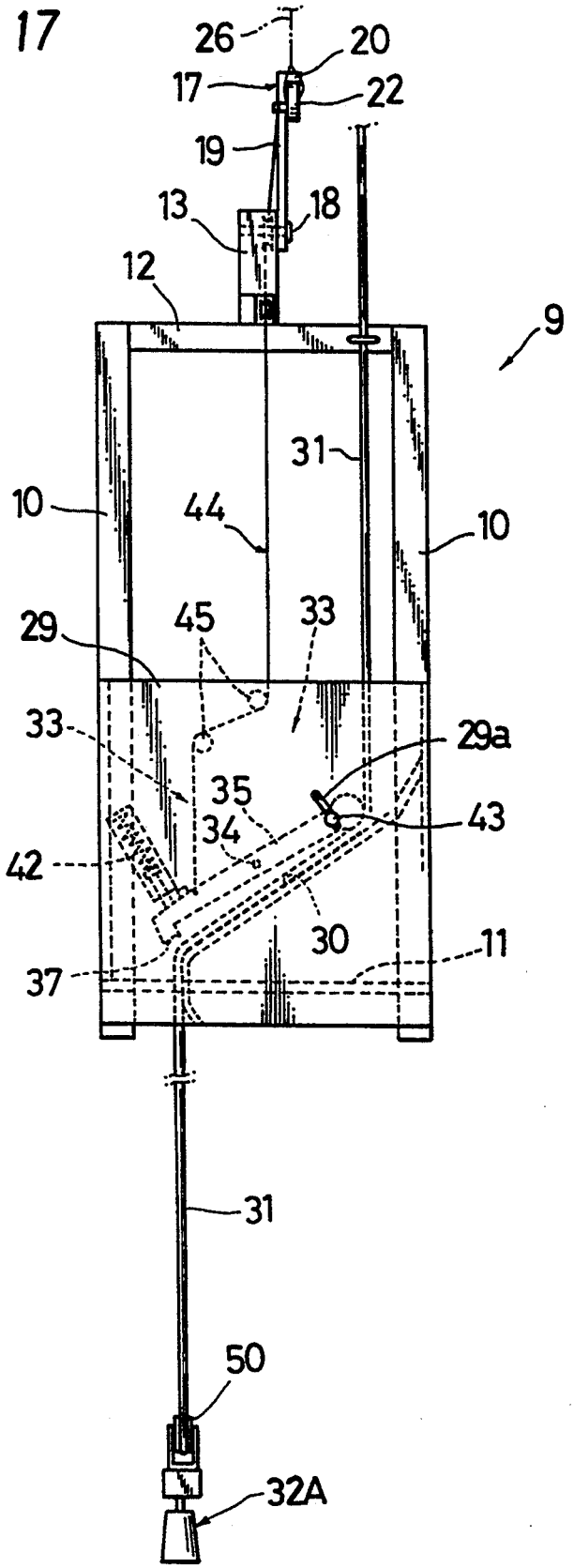

A fourth embodiment of the present invention shown in FIGS. 15 to 17 is distinguished from the first embodiment by the fact that the two supplementary ropes 31 are replaced with one single rope which carries at its lowermost end a couple of pulleys 50,50 provided with weights 32A,32A. A working gondola 47C having such a modification can prevent the supplementary rope 31 from being entangled during the up-, down-, left-, and rightward movement.

Figure 18:
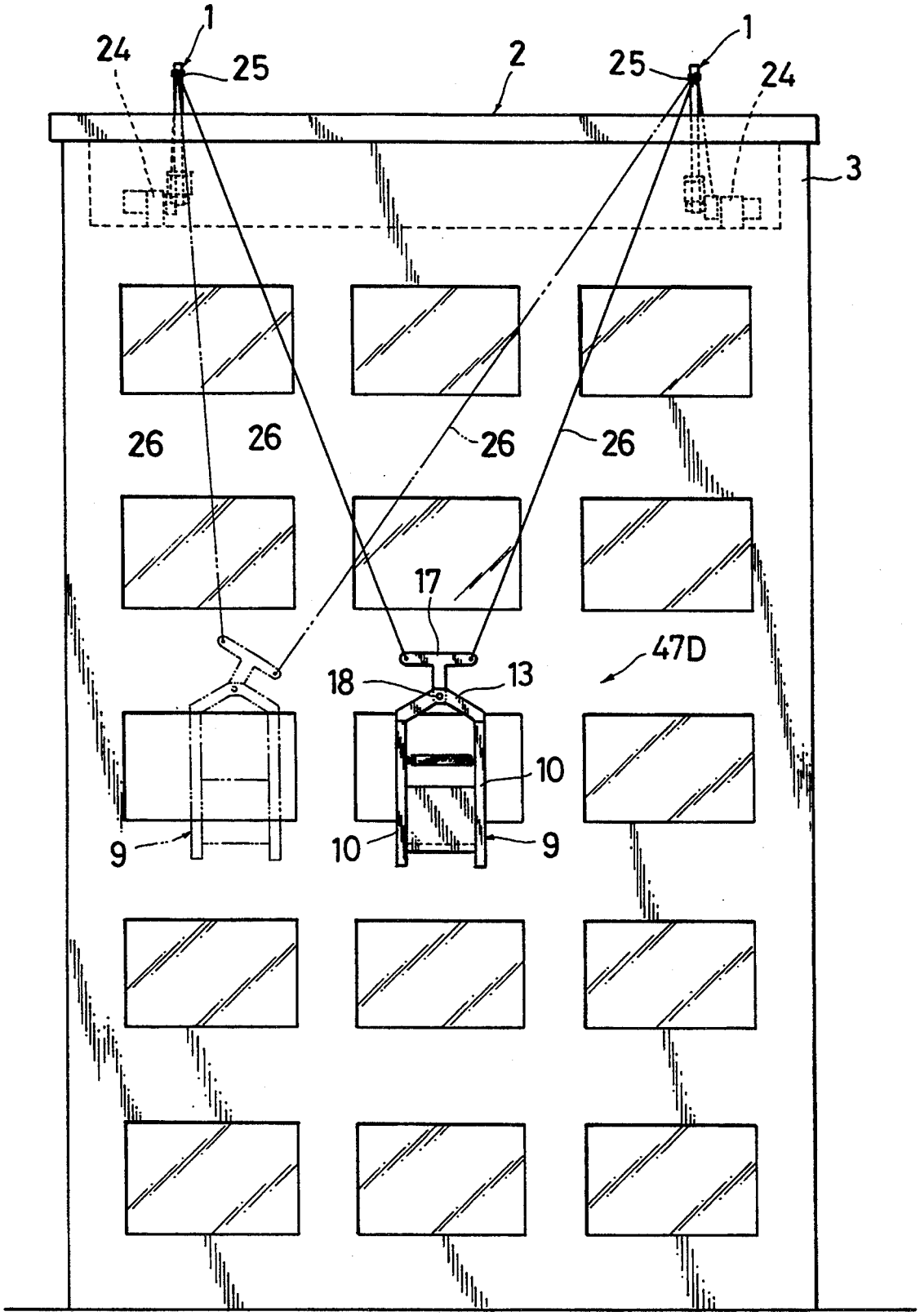
FIGS. 18 to 19 are explanatory views showing a fifth embodiment of the present invention.
Figure 19:
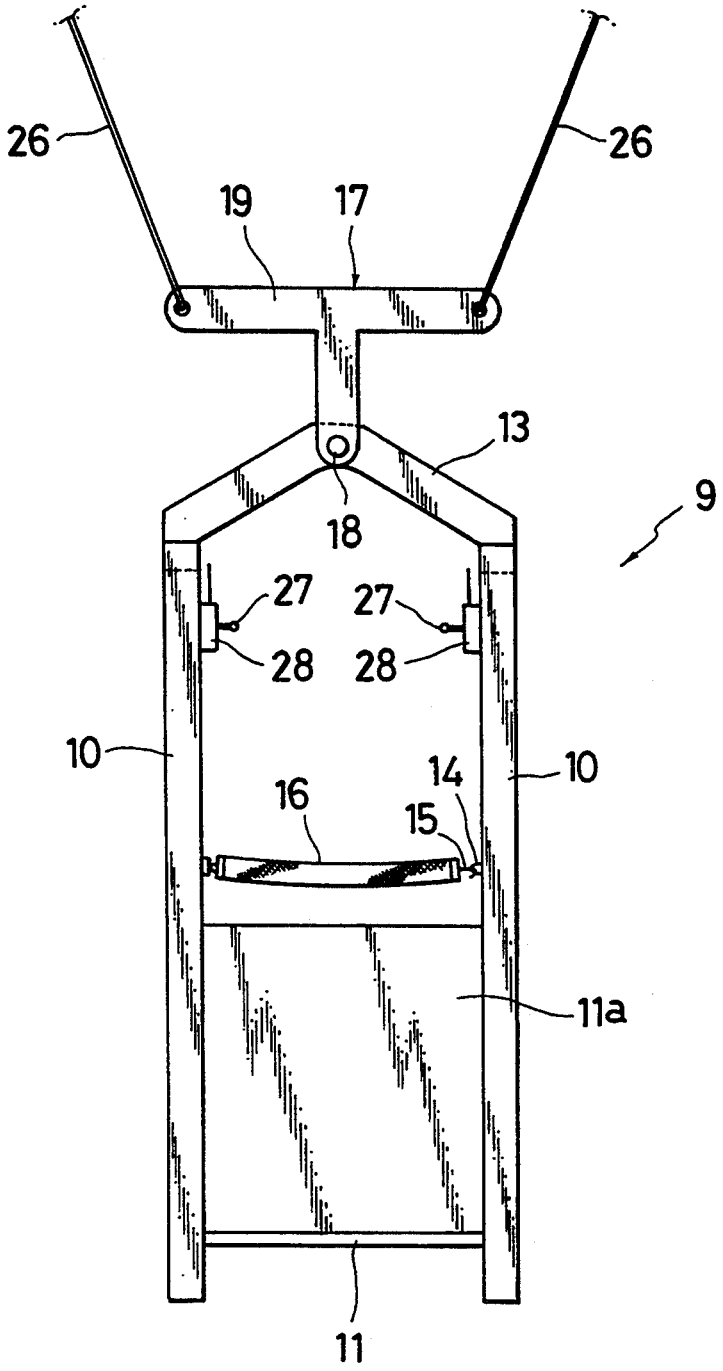

A fifth embodiment of the present invention shown in FIGS. 18 and 19 is distinguished from the first embodiment by the fact that both the supplementary ropes and the lock device are eliminated thus constituting a working gondola 47D of simple construction. Such a simple working gondola 47D can be manufactured at lower cost.

Figure 20:
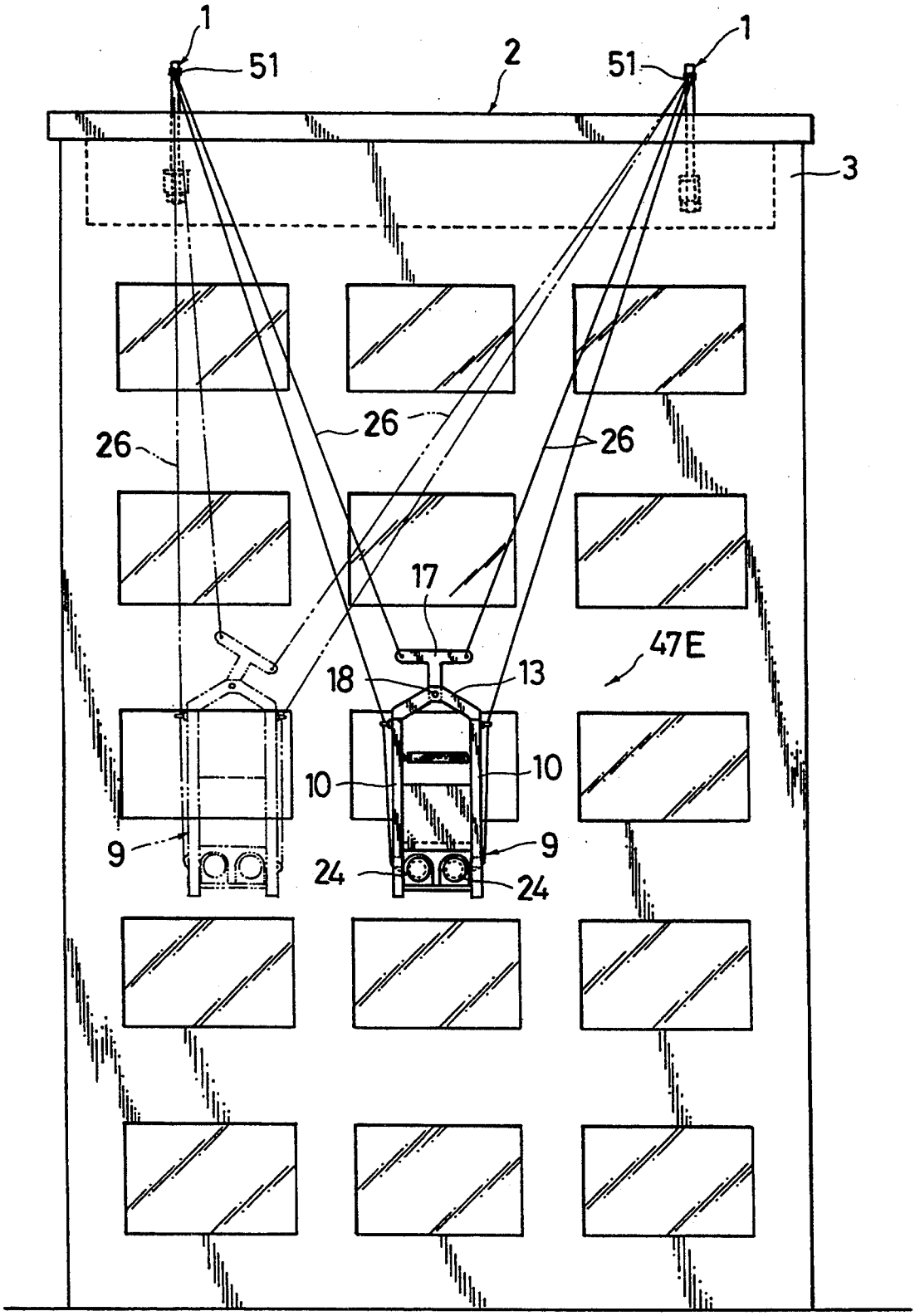
FIGS. 20 to 22 are explanatory views showing a sixth embodiment of the present invention.
Figure 21:
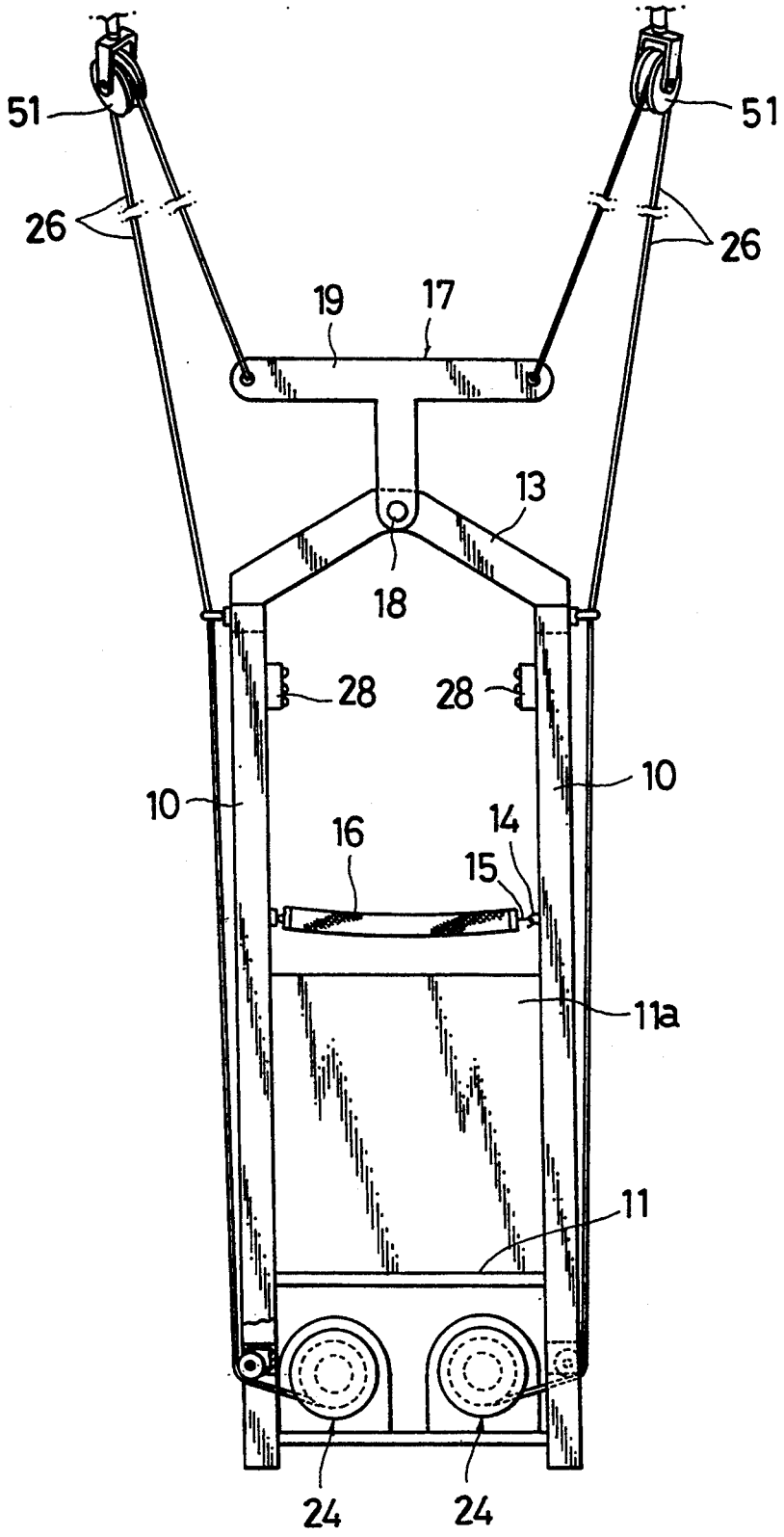
Figure 22:
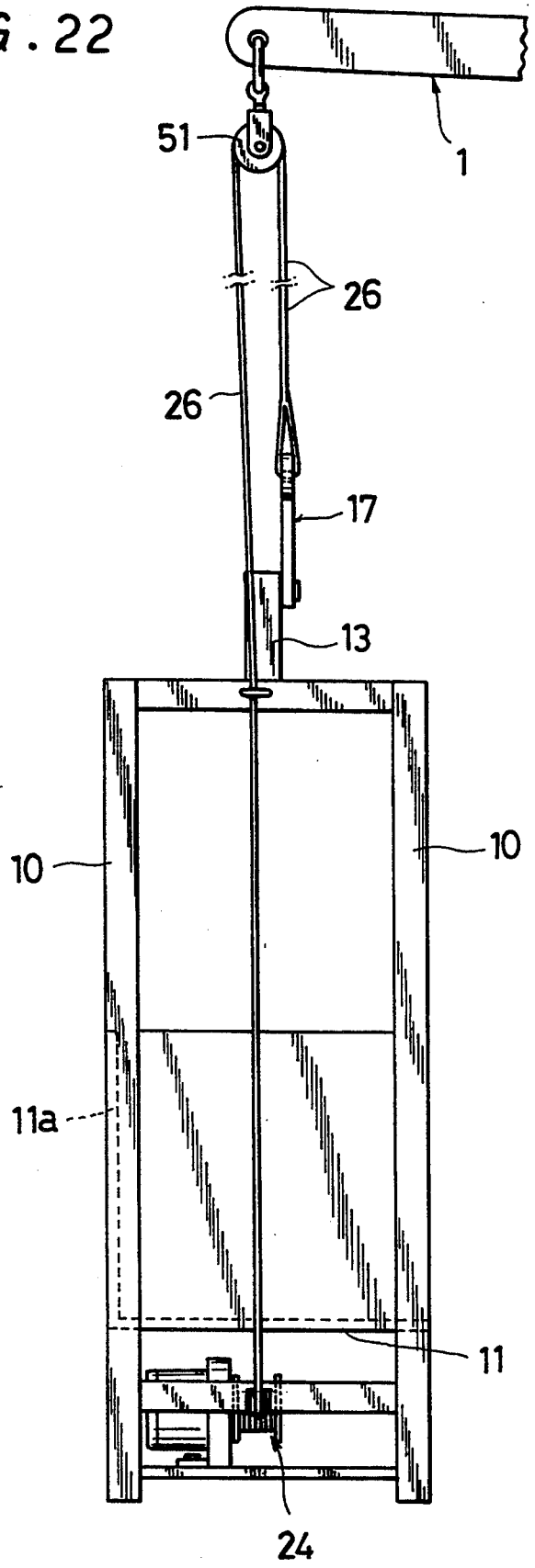
Figure 23:
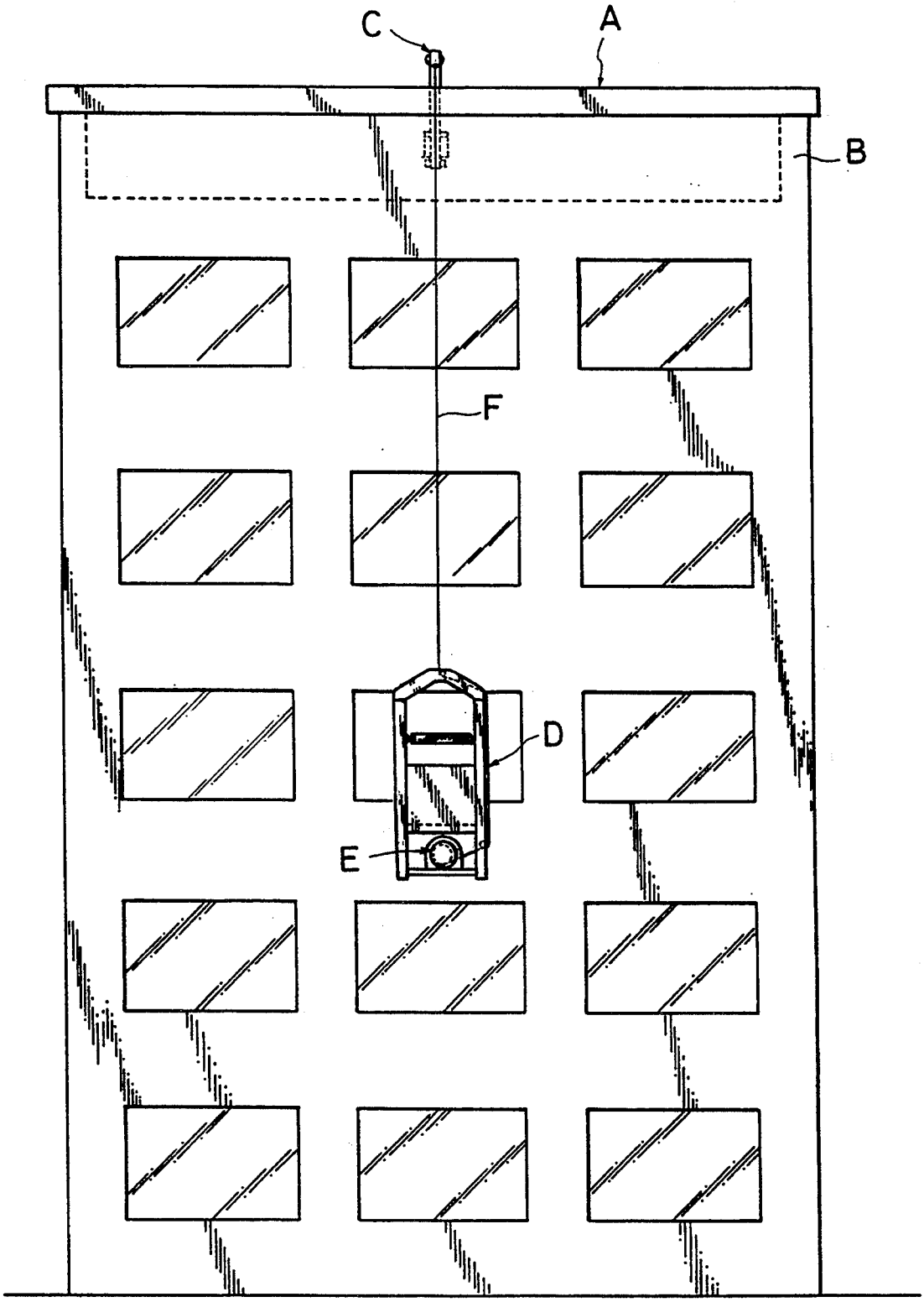
FIG. 23 PRIOR ART
FIGS. 23 and 24 are explanatory views showing a prior art working gondola.
Figure 24:
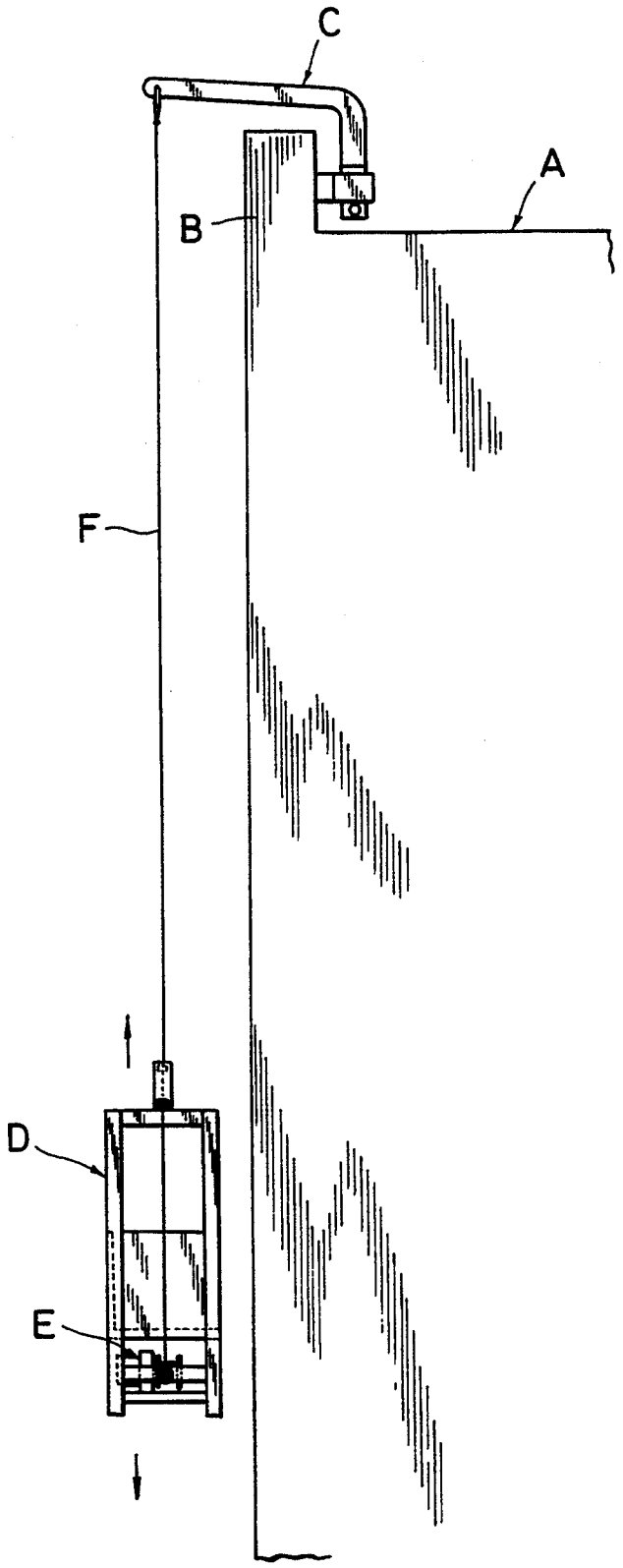
FIG. 24 PRIOR ART

A sixth embodiment of the present invention shown in FIGS. 20 to 22 is distinguished from the fifth embodiment by the fact that the two powered winches 24,24 are mounted on the gondola 9 for movement. Additionally, the leading ends of the two ropes 26,26 wound on their respective winches 24,24 extend through two rollers 51,51 mounted to the distal ends of the two gondola support arms 1,1 respectively and are coupled to both ends of the suspender 17. A working gondola 47E having such an arrangement can be used with equal success.

As set forth above, the present invention can provide the following effects.

(1) A working gondola of the present invention comprises: a gondola capable of carrying a worker for use in cleaning e.g. glass windows of a building structure; at least a pair of gondola support arms arranged at a distance from each other on the rooftop of the building structure and extending outward; a T-shaped suspender pivotably mounted to the upper of the gondola; and a gondola driver system for winding and unwinding a pair of ropes which extend downward from the distal ends of their respective gondola support arms to two side ends of the suspender respectively for up-, down-, left-, and rightward movement of the gondola. Accordingly, the gondola can be moved up-, down-, left-, and rightward by controlling the length of the two ropes with their respective powered winches.

As a result, glass window cleaning throughout an extended area will be conducted with efficiency.

(2) As depicted in the above paragraph (1), the up-, down-, left-, and rightward movement of the gondola is controlled by winding and unwinding the two ropes of their respective powered winches and will thus be executed with much ease.

(3) As depicted in the above paragraph (1), the gondola is suspended by the tiltable suspender hoisted with the two ropes so that it can remain hanging vertically during the left- and rightward movement ensuring safety in cleaning action.

What is claimed is:

1. A working gondola comprising:

a gondola capable of carrying a worker for use in cleaning e.g. glass windows of a building structure;

at least a pair of gondola support arms arranged at a distance from each other on the rooftop of the building structure and extending outward;

a T-shaped suspender pivotably mounted to the upper of the gondola;

a gondola driver system for winding and unwinding a pair of ropes which extend downward from the distal ends of their respective gondola support arms to two side ends of the suspender respectively for up-, down-, left-, and rightward movement of the gondola;

a pair of supplementary rope guide cases having supplementary rope guide passages therein and mounted to two outer side walls of the gondola respectively;

a pair of supplementary ropes coupled at one end to their respective gondola support arms or to proper locations of the rooftop of the building structure and hanging down through their respective supplementary rope guide passages of the two supplementary rope guide cases to the ground;

two lock devices installed in the two supplementary rope guide cases respectively, each lock device having a lock lever which, when its corresponding supplementary rope is accidentally snapped off, will automatically be pressed down against the supplementary rope guide passage by the movement of the snapped rope extending through the supplementary rope guide passage; and two lock release retainer devices provided for urging their respective lock levers of the two lock devices in lock release directions for free movement of the supplementary ropes, each device being arranged to, when its corresponding supplementary rope is accidentally snapped, release the lock action of the lock device through tilting motion of the T-shaped suspender.

2. A working gondola according to claim 1, wherein the gondola driver system is comprised mainly of two powered winches mounted on the rooftop of the building structure and actuated by a radio.

3. A working gondola according to claim 1, wherein the gondola driver system is comprised mainly of two powered winches mounted on the rooftop of the building structure and actuated by remote control.

* * * * *